US005494145A

United States Patent [19]

Cohrs et al.

[11] Patent Number: 5,494,145

[45] Date of Patent: Feb. 27, 1996

[54] COIN VALIDATOR FOR TESTING THE MASS OF A COIN

[75] Inventors: Hans-Ulrich Cohrs, Horneburg; Wilfried Meyer, Buxtehude, both of Germany

[73] Assignee: National Rejectors Inc. GmbH, Buxtehude, Germany

[21] Appl. No.: 226,756

[22] Filed: Apr. 12, 1994

[51] Int. Cl.[6] ..... G07D 5/04

[52] U.S. Cl. ..... 194/317; 194/339

[58] Field of Search ..... 194/317, 339, 194/334; 453/3, 4

[56] References Cited

U.S. PATENT DOCUMENTS

| | | | |
|---|---|---|---|
| 3,559,788 | 2/1971 | Jensen et al. | 194/317 |
| 3,653,481 | 4/1972 | Boxal et al. . | |
| 5,316,118 | 5/1994 | Ibarrola et al. | 194/317 |

FOREIGN PATENT DOCUMENTS

| | | | |
|---|---|---|---|
| 0038911 | 7/1983 | European Pat. Off. | G07F 3/02 |
| 2825094 | 12/1979 | Germany | 194/317 |
| 624500A5 | 12/1978 | Switzerland | H04M 17/02 |

*Primary Examiner*—F. J. Bartuska

*Attorney, Agent, or Firm*—Senniger, Powers, Leavitt & Roedel

[57] ABSTRACT

A coin validator which discriminates valuable coins includes a coin path along which the coins roll. A leaf spring is fixed at one end and has a spring member which projects into the coin path at the other end when the leaf spring is in a rest position. The leaf spring oscillates when the spring member is struck by a rolling coin. An evaluation circuit produces a timing signal as a function of the elapsed time between the striking of the spring member by the rolling coin and the time when the spring member first approaches the rest position after being struck. A memory stores reference values corresponding to valuable coins and a comparator compares the timing signal to the reference values for discriminating valuable coins.

4 Claims, 5 Drawing Sheets

COIN VALIDATOR FOR TESTING THE MASS OF A COIN

BACKGROUND OF THE INVENTION

In coin-operated vending machines, gambling devices and the like, inserted coins are checked for genuineness in a coin acceptor. Non-genuine coins are rejected whereas genuine coins initiate a purchasing procedure or some other function. The genuineness of coins can be checked with a mechanical coin acceptor or with an electronic coin acceptor. Prior art mechanical acceptors have used coin balances for checking the weight and the diameter of coins, slots for checking the thickness of coins and permanent magnets for determining the material. Prior art electronic acceptors have used electromagnetic or optical probes which determine the condition of the material, the diameter and the thickness of the coins and/or the condition of the coin edge. The output signals of the sensors are compared to reference values in an electronic circuit, for example, a circuit having a microprocessor. The circuit controls various flaps in accordance with the comparison in order to reject improper articles and to guide coins which fall within the tolerances of the reference values to a sorting mechanism or safe.

Electronic coin acceptors have the advantage that they can be made smaller in size because coins of different values roll along a common coin path. Of course, the reliability of an electronic test rises with the number of checking criteria. If only one checking criterion is selected such as type of material, it is often not possible to discriminate coins of foreign currencies but made of a similar material. If the diameter or the thickness or a further feature is added, a more reliable test is usually possible. Care should be taken when testing coins that the reference limits are not too narrow because the qualities of coins are subject to tolerances and vary in usage due to wear.

Swiss Application CH 6245 00 A5 shows a coin acceptor in which a section of the coin path is designed as a weighing table. However, since the coin is not held during its course over the weighing table, it is difficult to obtain an exact weight signal with this device.

European Application EP 0 038 911 shows the use of a spring above and at the end of a coin path which spring is deflected by a coin rolling down the coin path. Two sensors are associated with the spring which measure the deflection. The time which elapses during deflection in one direction and then back to the initial position is measured. This time is proportional to the mass of the coin. A flap is positioned at the end of the path which flap opens after the measurement has taken place in order to guide the coin to a valid money conduit or to a return conduit. The method is relatively complicated because the coin remains almost stationary during the measuring time. This can have an adverse effect on the insertion speed. Moreover, an additional actuation for the flap associated with the spring is necessary.

SUMMARY OF THE INVENTION

Among the objects of the present invention are to provide improved coin validators for discriminating valid coins from other valid coins or slugs by measuring the mass of an inserted article; to provide improved coin validators which are reliable, compact and economical; to provide improved coin validators which reliably authorize credit for valid coins; and to provide improved coin validators which reliably reject improper coins or slugs.

Generally, one form of the invention is a coin validator for discriminating valuable coins. The coin validator includes a coin path along which the coins roll and a leaf spring fixed at one end and having a spring member projecting into the coin path at the other end when the leaf spring is in a rest position. The leaf spring oscillates when the spring member is struck by a coin rolling along the coin path. An evaluation circuit produces a timing signal as a function of the elapsed time between the striking of the spring member by the rolling coin and the time when the spring member first approaches the rest position after being struck. The coin validator also includes a memory which stores reference values corresponding to valuable coins and a comparator which compares the timing signal to the reference values for discriminating valuable coins.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

One embodiment of the invention comprises a spring system above or below the coin path in a coin validator having a member which projects into the coin path. When an inserted article rolls along the coin path, it strikes and rolls over the projecting member of the spring system. A spring-mass system is formed which constitutes a mechanical oscillatory circuit whose period is a function of a known spring constant and of the mass of the spring and inserted article. A time measuring device measures the time from the start of the deflection of the spring system until the first approach of the spring system back through its initial position. The device then compares the measured time value with a given value. The time measured between the deflection of the spring system until the first approach back through the initial position is the base time in which the spring system and the inserted article are mechanically coupled. Consequently the time represents a measure of the mass of the inserted article, independent of the oscillation amplitude, so that a discrimination according to mass can be made. Accordingly, lead slugs and other improper articles can be readily sorted out.

A suitable measuring sensor is provided for measuring the deflection time of the spring. Various types of sensors are available for this application. The measuring sensor preferably generates an analog signal as a function of the deflection of the spring system. The sensor may comprise a magnetic coil which is variably damped depending on the deflection of the spring system. Likewise, the sensor may comprise an optical measuring device. A Hall element can also be used as the measuring sensor which advantageously minimizes the effect of mechanical conditions and design tolerances on the measured result.

Figure 1:
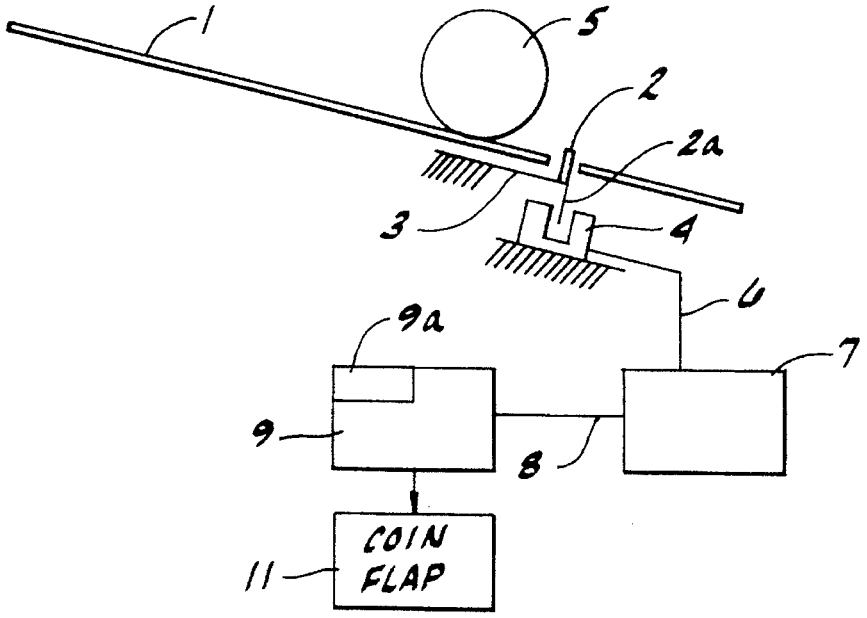
FIG. 1 is a schematic diagram showing a mass detector using a spring system and photoelectric sensor.

FIG. 1 shows a coin path 1 along which a coin 5 (or other inserted article) is rolling. A leaf spring 3 is permanently fixed at one end below coin path 1 and comprises a bent shoulder 2 at its free end which shoulder extends through an opening into coin path 1. A photoelectric sensor 4 is arranged below the free end of leaf spring 3. Sensor 4 comprises a phototransistor and a light source such as a photoelectric diode. A sheet 2*a* is arranged at the free end of leaf spring 3 which sheet partially extends between the phototransistor and light source of sensor 4. The output of the phototransistor is connected to an evaluation circuit 7 which is connected via a lead 8 to a microprocessor 9.

Figure 3:
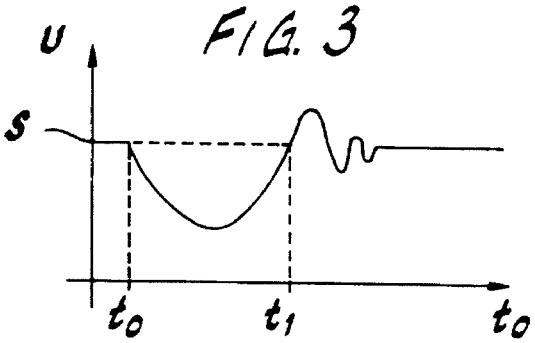
FIG. 3 shows the oscillatory behavior of the spring system of the devices of FIGS. 1 and 2.

When coin 5 meets shoulder 2, coin 5 forms a spring system with leaf spring 3 whose period is a function of the spring constant or stiffness and of the mass of the spring 3 and coin 5. Sensor 4 measures the covering of the phototransistor upon an oscillation of leaf spring 3 so that an analog signal shown in FIG. 3 results. The deflection path is indicated on the ordinate and the deflection time on the abscissa of FIG. 3. Consequently, "S" designates the initial position of leaf spring 3 and the time $t_0$ designates the time at the start of the deflection of the leaf spring. Time $t_1$ shows when the leaf spring 3 has returned for the first time back through the initial position. Therefore, the time difference $t_1 - t_0$ varies as a function of the mass of the coin 5. Care must be taken that, independent of the mass of the coin to be checked, shoulder 2 is constantly coupled with coin 5 during the deflection. Shoulder 2 must not be pressed below coin path 1 even at the greatest mass.

Figure 4:
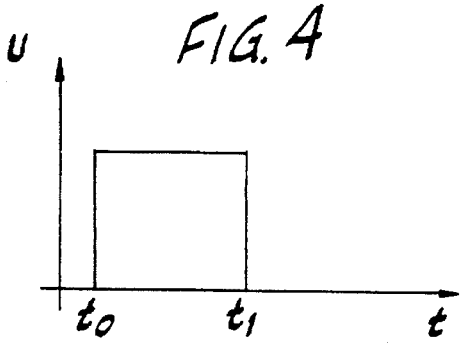
FIG. 4 shows the modified digital signal of FIG. 3.

Evaluation circuit 7 converts the analog signal into a digital timing signal shown in FIG. 4. The timing signal varies as a function of the elapsed time between the striking of bent shoulder 2 on spring 3 and the time when spring 3 first approaches its rest position after being struck. A microprocessor 9 receives the timing signal via a line 8. Microprocessor 9 includes a memory 9A for storing reference values corresponding to valuable coins. Microprocessor 9 compares the timing signal produced when a coin strikes shoulder 2 with the stored reference values to discriminate valuable coins. Inserted coins causing a timing signal which falls within a predetermined tolerance for the stored reference values are accepted for credit via a conventional coin flap 11 which is controlled by microprocessor 9. The rest of the inserted coins and articles are preferably returned to the user via flap 11. Alternatively, the stored reference values may be stored as a range within which the timing signal must fall for the coin to be accepted and credit given.

Figure 2:
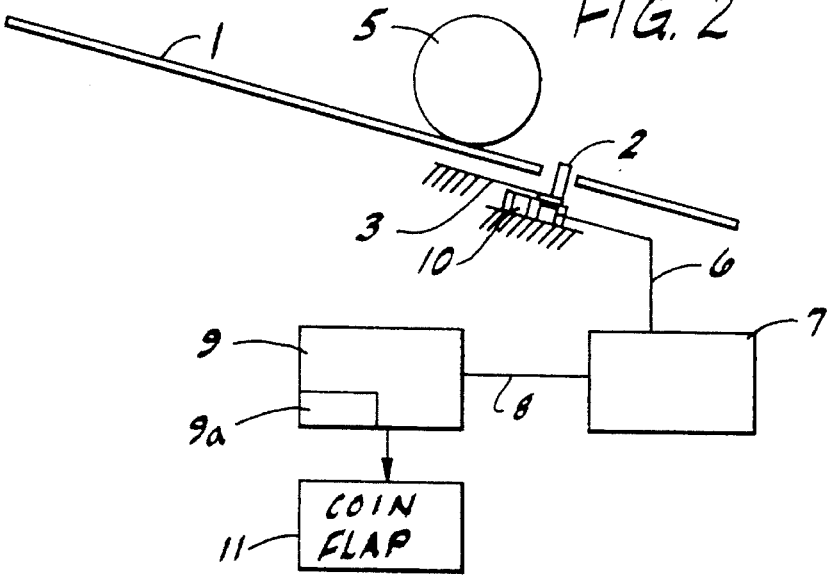
FIG. 2 is a schematic diagram showing a mass detector using a spring system and magnetic sensor coil.

FIG. 2 is similar to FIG. 1 except that FIG. 2 uses an electric coil 10 to sense the position of leaf spring 3. Coil 10 is part of an electrically oscillating circuit. As spring 3 approaches coil 10, the air gap between them narrows and the damping of the oscillatory circuit changes. Signal evaluation circuit 7 converts the analog signal produced by the oscillatory circuit to a digital timing signal. The timing signal varies as a function of the elapsed time between the striking of bent shoulder 2 on spring 3 and the time when spring 3 first approaches its rest position after being struck. Microprocessor 9 compares the timing signal with the reference values stored in memory 9A to discriminate valuable coins. Again, coin flap 11 is used to retain valid coins for credit and to return the rest of the inserted coins and articles to the user.

Coin validation by weight is also possible in an alternative embodiment using a weighing table coupled to a spring arrangement in such a manner that the deformation of the spring arrangement is independent of the position of the coin on the weighing table. The weighing table is of sufficient size so that enough time remains for a weight sensor to produce a signal corresponding to the weight of the coin or other inserted article.

Such a spring arrangement for a weighing table may comprise a dual flexible beam system. In this system, two spring beams are coupled rigidly to one another at the ends. The weighing table is rigidly connected to one end of the dual beam arrangement. The deformation of the dual beam is a function solely of the weight on the weighing table, independent of the position of the weight. The weight sensor is positioned to monitor the beam deformation and output a signal as a function of the weight of the coin or article on the weighing table. The deformation is determined from the flexing of the beam. It can also be determined by determining the position of the weighing table relative to the position of the beams, which varies depending on the flexing of the beams.

Other weight sensors which can be used to measure the flex in a spring system are known in the art. For example, the deformation of the spring arrangement can be measured with a wire strain gauge. The wire strain gauge is connected to a flexible beam in order to generate a signal dependent on the amount of flexing. Alternatively, the deformation of the spring arrangement can be measured with a piezo element, an electric coil in an oscillatory circuit or a Hall sensor in conjunction with a permanent magnet.

When using a wire strain gauge, a flexible strip is preferably arranged in the neutral zone between the flexible beams which carries a wire strain gauge. In this arrangement the flexible strip is loaded by the flexing motion of the beams and not by traction or pressure like the flexible beams. This allows a relatively precise measurement. The use of wire strain gauges for electronic balances is known. The available wire strain gauges weigh masses of 100 g to several tons. A weighing capacity of approximately 25 g is sufficient for the coins in circulation throughout the world. Nevertheless, wire strain gauges capable of measuring weights above 100 g can be used with the invention. The reason is that it is not necessary in a device for separating coins to determine the exact weight. A weighing device in accordance with the invention is also not subject to official calibrating standards. The sole object is to discriminate differences in weight, that is, to determine whether a coin to be tested deviates in relation to a reference weight of 25 g by 0.1 or 0.2 g. Such a discrimination can be carried out very well with traditional wire strain gauges.

The weight sensor for measuring deformation can also be constructed using an electromagnetic coil positioned adjacent the spring arrangement in such a manner that an air gap is formed between the two which changes during the deformation of the spring arrangement. The change of inductance resulting thereby is evaluated with the circuitry of FIG. 9 as more fully described below. For example, a metal flag can be connected to the spring arrangement which flag covers a ferrite core to a greater or lesser extent. Alternatively, a Hall sensor can be provided through which the field of a permanent magnet passes. The field change in the Hall sensor is then utilized to determine spring position.

The spring arrangement for the weighing table is preferably formed as a stamped and/or bent part from a suitable sheet material. Thus, a U-shaped sheet part can be provided having shanks forming the flexible beam and having a web between the ends of the shanks. Such a U-shaped spring arrangement can enclose the weighing table. Alternatively, the weighing table may be permanently attached to a shank. The weighing table or the path section forming the weighing table can be arranged in such a fashion that the coin runs down on it without wall contact. Often times, however, the influence of friction from the wall is negligible in the determination of weight. The coin on the path section can therefore be supported at the same time on a side wall.

A relatively high resolution is required for some coins in order to discriminate them from non-genuine coins. A two stage amplifier, such as an amplifier 82 in the circuitry of FIG. 9, allows the gain to be increased for coins requiring a high resolution and decreased for coins requiring less resolution. Further, by providing an additional sensor upstream from the weight sensor/weighing table to sense the value of the inserted coin, the gain of the two stage amplifier is set to the required resolution for the expected coin. An improvement therefore provides that the amplifier comprises at least two stages of differing amplification and that the selection of the amplification stage is rendered dependent on the output signal of the additional sensor.

As a result of the path-independent weighing, the output signal of the weight sensor is approximately constant while the coin runs over the weighing table. However, a prerequisite for this is that the coin runs totally smoothly and exhibits no imbalance. If the mass in a coin is not uniformly distributed and/or if the edge exhibits irregularities (such as a milled edge), then the weighing table is dynamically loaded which causes a corresponding change in the output signal of the weight sensor. This phenomenon can likewise be used to discriminate coins. To this end, the output signal of the weight sensor can be compared with a theoretical curve in order to separate out non-genuine coins or to accept genuine ones.

Figure 6A:
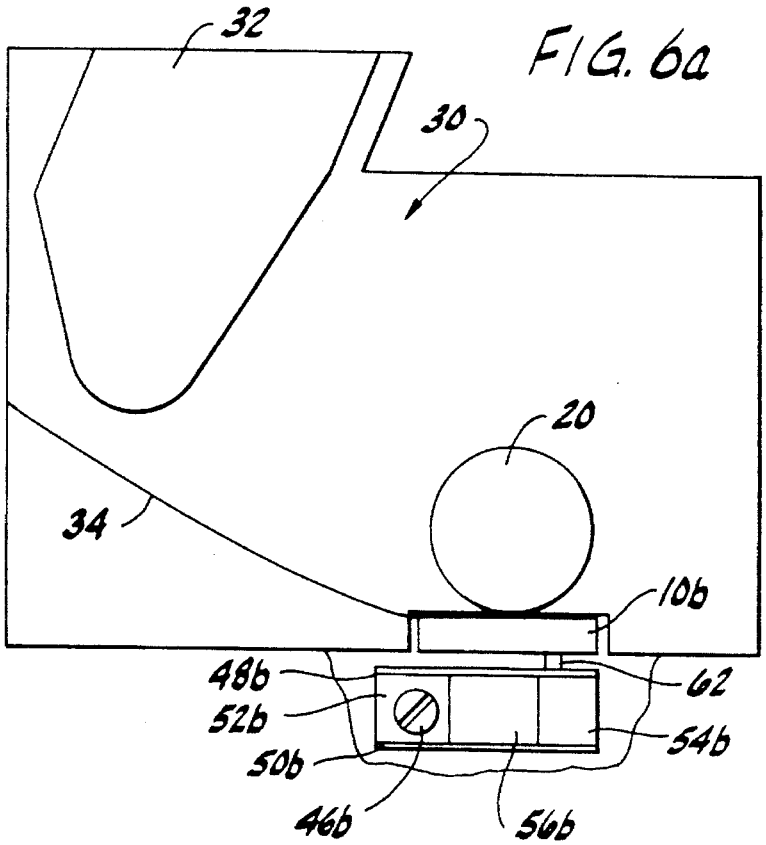
FIGS. 6*a* and 6*b* show front and lateral views in partial section of a coin validator for testing the mass of a coin using a weighing table.
Figure 6B:
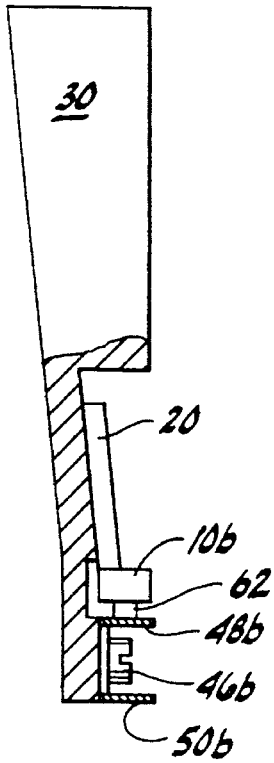
Figure 7:
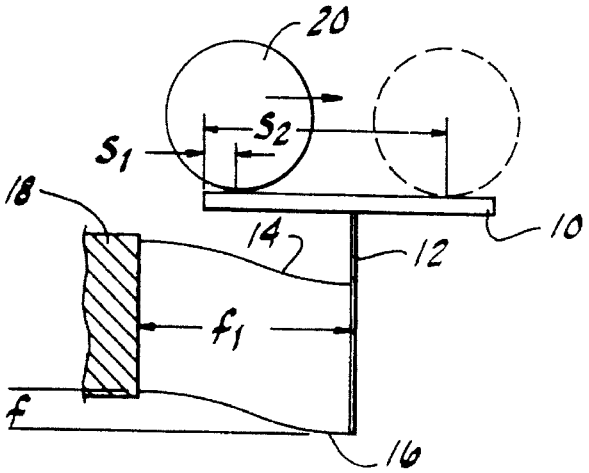
FIG. 7 is a schematic diagram showing a weighing table.

FIG. 7 shows a weighing table 10 rigidly connected via a rod 12 to two flexible beams 14 and 16 at one end. Weighing table 10 is a component of a coin path 34 in a coin acceptor like that shown in FIGS. 5 and 6. Flexible beams 14 and 16 are permanently connected to carrier construction 18. FIG. 7 shows how a coin 20 moves along weighing table 10. The bending f of beams 14 and 16 caused as a result is a measure of the weight of coin 20, which bending is independent of the position of coin 20 on weighing table 10. Since a certain lead time is necessary, e.g. table section $S_1$, the path $S_2$ is available for weight measurement of coin 20. Flexing f can also be measured with the aid of a suitable position sensor.

Figure 8:
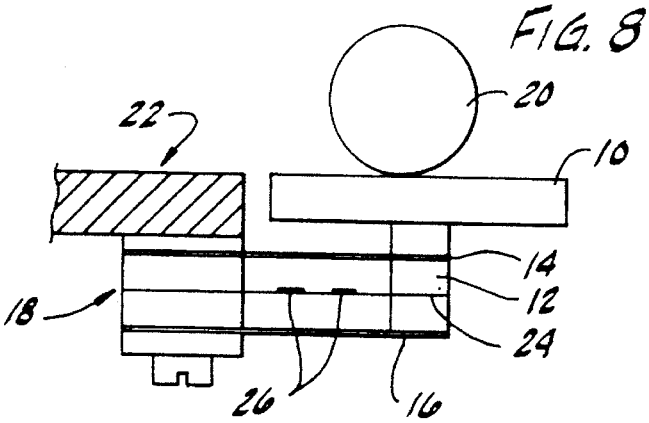
FIG. 8 is a schematic diagram showing an alternate weighing table.

FIG. 8 shows a practical device for weighing a coin. A carrier construction 18 for beams 14 and 16 is fastened to the bottom of a coin path 22, of which weighing table 10 constitutes a section. A spring strip 24 is rigidly connected to carrier construction 18 and rigid rod 12. Strip 24 is located in the neutral zone, that is, it is loaded exclusively by bending, in contrast to beams 14 and 16 which are also loaded by traction and pressure. Two wire strain gauges 26 are attached to strip 24, preferably by adhesion. Their deformation is a function of the bending of strip 24, which bends as a function of the weight of coin 20. The output signal of wire strain gauges 26 therefore varies as a function of the weight of coin 12 independently of its position on weighing table 10.

Flexible beams 14 and 16 are preferably made of a substance with a low temperature-dependent E modulus. For compensation and reduction of the temperature dependency, the wire strain gauges are selected so that they inversely exhibit temperature-dependent behavior.

Figure 5A:
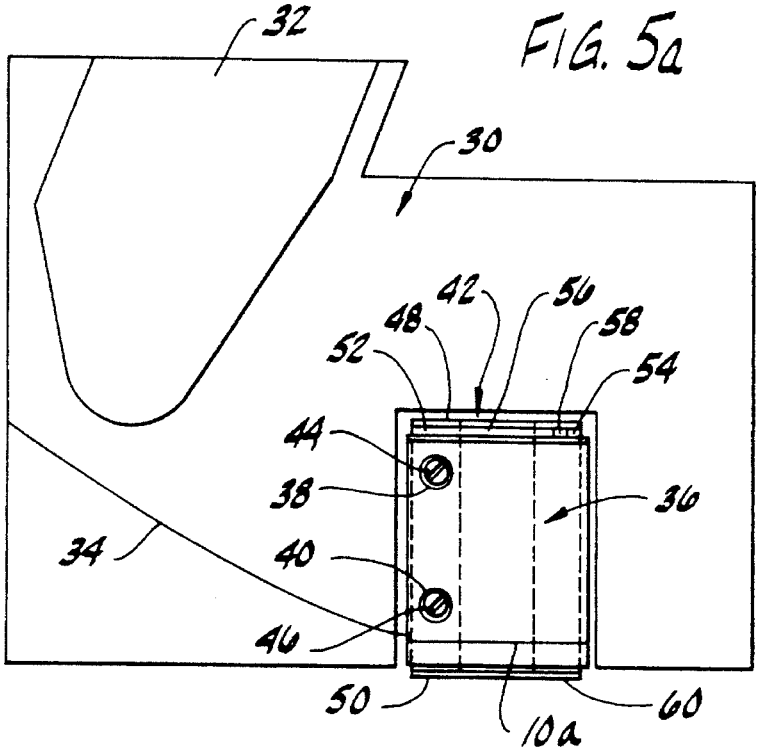
FIGS. 5*a* and 5*b* show front and lateral views in partial section of a coin validator for testing the mass of a coin using a weighing table.
Figure 5B:
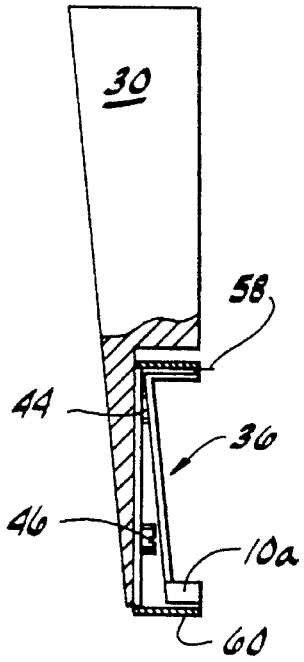

A coin acceptor 30 according to FIGS. 5*a* and 5*b* comprises a coin slot 32 as well as coin path 34 below slot 32. Weighing table 10*a* is a component of an approximately U-shaped sheet part 36 having two holes 38 and 40 on the left side in FIG. 5*a*. U-shaped spring arrangement 42 is fastened behind U-shaped sheet part 36 with the aid of screws 44 and 46 to coin acceptor 30. The screws can be accessed via holes 38 and 40. Upper shank 48 and lower shank 50 form a dual flexible beam which is rigidly coupled by two spaced sections 52 and 54 of the web of the U arrangement. Sections 52 and 54 are formed by stamping out a central recess 56. U arrangement 36 is rigidly connected via upper connection piece 58 and lower connection piece 60 to the bottom of upper shank 48 and the top of lower shank 50. This results in a dual flexible beam system like that schematically shown in FIG. 7. The web of U-shaped component 36 is inclined (lateral view in FIG. 5*a*) so that a coin rolling on weighing table 10*a* makes no wall contact.

FIG. 6 shows a weighing table 10*b* as a component of coin path 34. The spring arrangement shown in FIG. 6 comprises a U-shaped component similar to that of FIG. 5. Parallel shanks 48*b* and 50*b* are coupled via web sections 52*b* and 54*b* and section 52*b* is fastened to coin acceptor 30 by screw 46*b*. Weighing table 10*b* is rigidly connected via connection piece 62 to the top of upper shank 48*b*. The top of weighing table 10*b* is slightly inclined to the horizontal so that coin 20 rolls over said table with wall contact. The wall contact of the coin during the measuring influences the latter only slightly so that even the measuring system shown in FIG. 6 can manage with a rather small space requirement.

Figure 10:
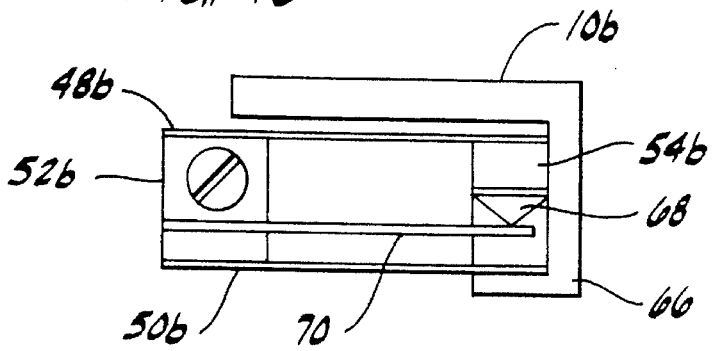
FIG. 10 is a schematic diagram showing an alternate weighing table.

FIG. 10 shows a spring arrangement similar to that of FIG. 6. Weighing table 10*b* is connected via downwardly facing shoulder 66 at one end to web section 54*b* and shoulder 66 extends under lower shank 50*b* from below. Moreover, edge 66 is rigidly connected to web section 54*b* which edge acts on piezo element 70 rigidly connected to web section 52*b*. A deformation of the dual flexible beam system therefore also results in a bending of piezo element 70. Due to the transfer of force, longitudinal forces onto piezo element 70 are excluded, so that once again the required path independence of the measuring is guaranteed.

Figure 9:
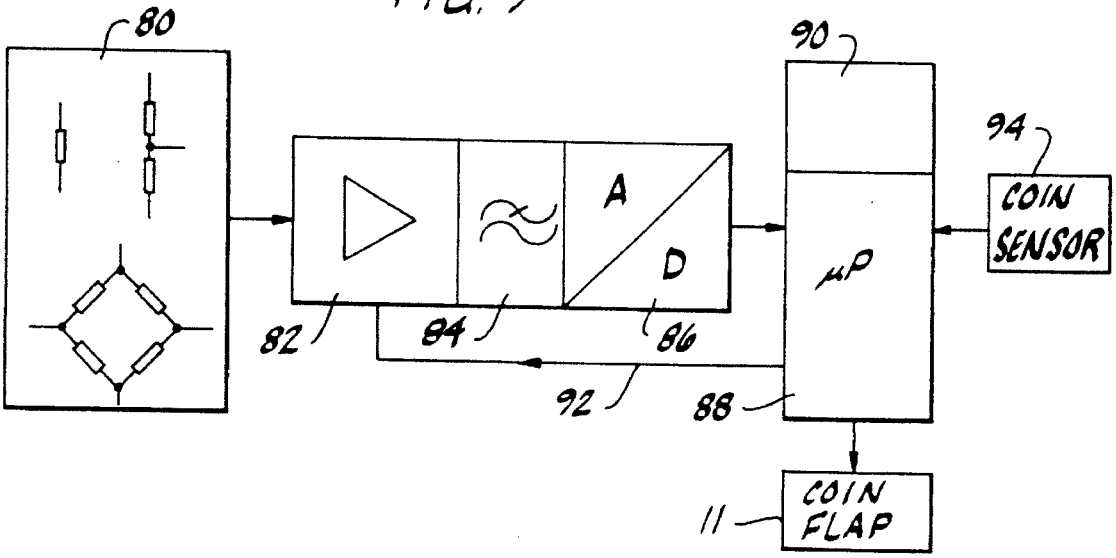
FIG. 9 shows a block diagram of the circuitry for evaluating the signals from the weighing table.

In the circuit arrangement of FIG. 9, it is assumed that the weight sensing takes place with the aid of one or more wire strain gauges, coils, Hall devices, etc. which are generally indicated in block 80. Their output signal is passed to amplifier 82. The amplified signal is input via filter 84 to digitizer 86, whose output is connected to a microprocessor 88. A memory 90 is also connected to microprocessor 88 which memory contains the program for the separation of coins with the devices shown. Memory 90 contains the reference values for the weights of individual coins which are compared with the particular measured weight signals.

The load range of known wire strain gauges ranges from approximately 2N to $10^7$N for the obligatory calibrating range. Graduation values of 5000 steps are necessary for this. The measuring range for coins runs to approximately 0.25N. A resolution of $1\times10^{-3}$N is totally sufficient since the coins in circulation have a weight tolerance of approximately $\pm2\times10^{-3}$N. The required measuring steps of 250 parts can therefore be readily achieved with known electronic receivers having a rated load of up to 10N.

Figure 11A:
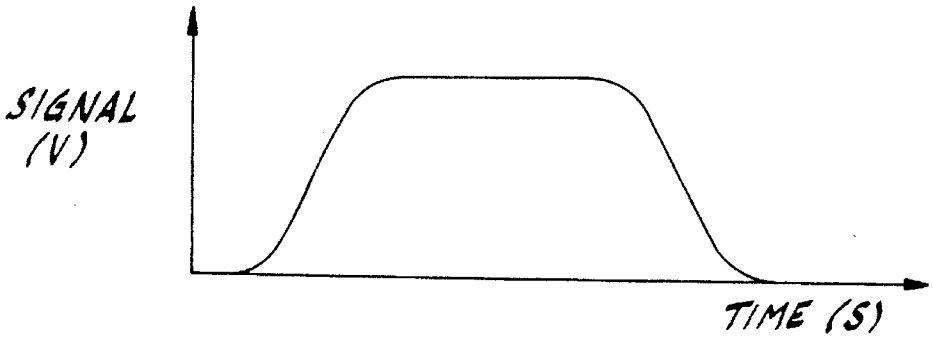
FIGS. 11*a* to 11*c* show different output signals of the weighing table of the invention.

When a coin rolls smoothly over the weighing table, this yields an output signal on the output of amplifier 82 and/or of filter 84 like that shown in FIG. 11*a*. After a certain building-up time the level or amplitude of the measured signal remains approximately constant and then swings back to zero when the coin leaves the weighing table. A measuring time of 0.1 second is completely sufficient thereby for the weight measuring. The curve of FIG. 11*a* assumes that the distribution of mass in the coin is totally uniform.

Figure 11B:
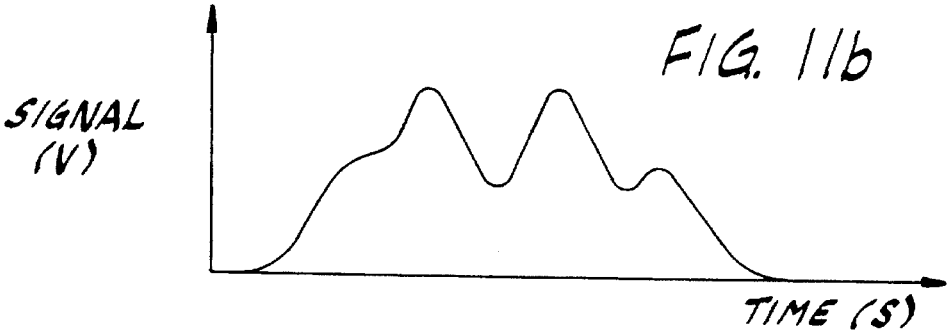
Figure 11C:
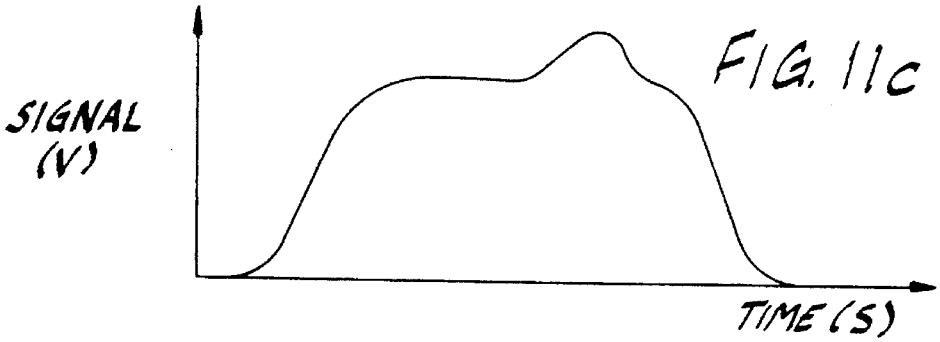

FIG. 11*b* shows the analog signal generated by a regularly formed, polygonal coin. The dynamic forces superimposed on the static weight force are shown at a different distribution of mass. A corresponding signal would also result in the case of a coin with a segmented milled edge. A coin separation can also be achieved by means of an analysis of the analog signals if two coins have the same static weight force but exhibit a different distribution of mass. FIG. 11*c* shows the analog signal for a nonhomogenous coin.

An advantage of the circuitry of FIG. 9 is that a direct-voltage decoupling takes place between wire strain gauge 80 and amplifier 82 so that potential problems of zero point drift due to temperature changes or other environmental influences are avoided. Amplifier 82 may comprise two or more amplification stages which can be switched into the circuit selectively via signal leads 92 from microprocessor 88. The selection of the amplification stage determines the resolution during the determination of weight. If, for example, a high resolution is necessary in the case of a certain coin, a higher amplification is selected. The criterion for selecting the particular amplification stage may come from a sensor 94 arranged upstream from the weighing device. The particular value of the coins is recognized with the aid of sensor 94, so that specific coins are tested using predetermined amplification ranges. For this reason, it may be important to place the weighing table at the end or near the end of the coin path.

Figure 12:
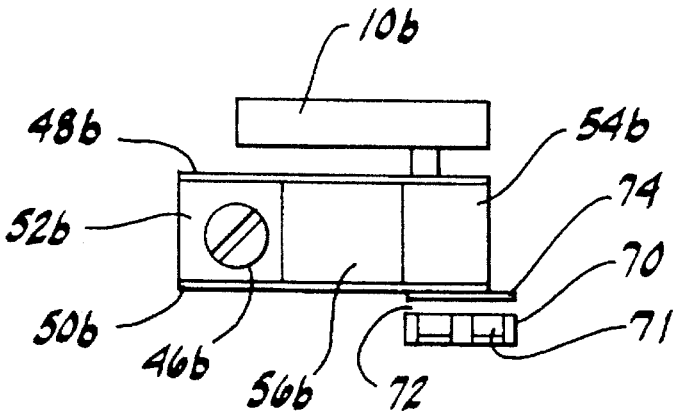
FIG. 12 shows a spring arrangement similar to that of FIG. 6 but using a magnetic coil to sense spring position.
Figure 13:
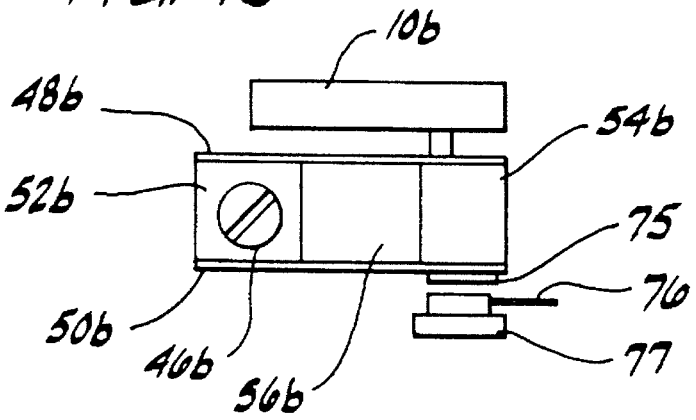
FIGS. 13 and 14 show a spring arrangement similar to that of FIG. 6 but using a Hall sensor to determine spring position.
Figure 14:
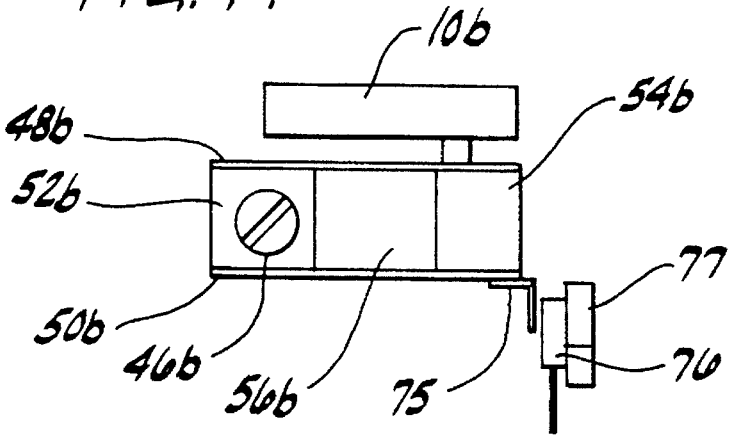

FIGS. 12 to 14 show similar spring arrangements to the arrangement shown in FIG. 6; however, the weight sensors are different. In FIG. 12 a cover sheet 74 is connected to lower web 50*b* of the spring arrangement. A coil 70 with a ferrite pot core 71 is located below cover sheet 74. An air gap 72 is located between coil 70 and cover sheet 74, the size of which air gap varies during the deformation of the spring arrangement. Accordingly, when a coin runs over weighing table 10*b*, air gap 72 becomes smaller. This causes a measurable change in the inductance of coil 70 which is detected, for example, with a traditional oscillatory circuit. A reduction of the air gap results in a damping of the oscillatory circuit and a measuring amplifier connected at the outlet side evaluates the amplitude and/or the frequency change of the output or envelope. The analog output signal is input to amplifier 82 shown in the evaluation circuit of FIG. 9 for further processing.

FIG. 13 shows a cover sheet 75 attached to the bottom of web 50*b* which is positioned above Hall sensor 76. Sensor 76 is connected to permanent magnet 77. The magnetic field of magnet 77 passes through the magnetoresistive chip surface of Hall sensor 76. The magnetic field varies with changes in the relative position of cover sheet 75 and Hall sensor 76. The output voltage of Hall sensor 76 is processed via amplifier 82 in the manner described above for the circuitry of FIG. 9.

FIG. 14 shows Hall sensor 76 and permanent magnet 77 rotated 90° from their positions shown in FIG. 13. An angular cover sheet 75 is attached to the bottom of web 50*b* and covers a part of the surface of Hall sensor 76. When the spring arrangement bends, the covered area varies and with it the magnetic field passing through Hall sensor 76 also varies. The output voltage of Hall sensor 76 is processed via amplifier 82 in the manner described above for the circuitry of FIG. 9.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A coin validator for discriminating valuable coins comprising:

a coin path along which the coins roll;

a leaf spring fixed at one end and having a spring member projecting into the coin path at the other end when the leaf spring is in a rest position, the leaf spring including a portion running along the coin path between the fixed end and the spring member;

wherein the leaf spring oscillates when the spring member is struck by a coin rolling along the coin path and wherein the rolling coin deflects the spring member away from the coin path as the coin rolls along the coin path;

an evaluation circuit for producing a timing signal as a function of the elapsed time between the striking of the spring member by the rolling coin and the time when the spring member first approaches the rest position after being struck;

a memory for storing reference values corresponding to valuable coins; and a comparator for comparing the timing signal to the reference values for discriminating valuable coins.

2. The coin validator of claim 1 further comprising a position sensor for outputting an analog signal as a function of the position of the spring member, wherein the evaluation circuit is responsive to the position sensor for producing the timing signal as a function of the analog signal.

3. The coin validator of claim 2 wherein the position sensor comprises a magnetic coil whose damping varies as a function of the position of the spring member, wherein the magnetic coil outputs the analog signal to the evaluation circuit as a function of said damping.

4. A coin validator for discriminating valuable coins comprising:

a coin path along which the coins roll;

a leaf spring fixed at one end and having a spring member projecting into the coin path at the other end when the leaf spring is in a rest position; wherein the leaf spring oscillates when the spring member is struck by a coin rolling along the coin path;

a position sensor for outputting an analog signal as a function of the position of the spring member;

a sheet member projecting from and oscillating with the leaf spring;

wherein the position sensor comprises a light source and a light detector positioned on opposite sides of the sheet member; and wherein the light detector outputs the analog signal to the evaluation circuit as a function of the position of the spring member during oscillation of the leaf spring;

an evaluation circuit for producing a timing signal as a function of the elapsed time between the striking of the spring member by the rolling coin and the time when the spring member first approaches the rest position after being struck;

wherein the evaluation circuit is responsive to the position sensor for producing the timing signal as a function of the analog signal;

a memory for storing reference values corresponding to valuable coins; and a comparator for comparing the timing signal to the reference values for discriminating valuable coins.

* * * * *